US007356945B2

(12) United States Patent
Choi et al.

(10) Patent No.: US 7,356,945 B2
(45) Date of Patent: Apr. 15, 2008

(54) OPERATION METHOD AND DEVICE FOR COMBINATION DRYER

(75) Inventors: Soung Bong Choi, Changwon-si (KR); Deug Hee Lee, Gimhae-si (KR); Byung Hwan Anh, Gimhae-si (KR); Hung Myong Cho, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 24 days.

(21) Appl. No.: 11/269,884

(22) Filed: Nov. 9, 2005

(65) Prior Publication Data

US 2006/0112585 A1 Jun. 1, 2006

(30) Foreign Application Priority Data

Nov. 10, 2004 (KR) ..... 10-2004-0091274

(51) Int. Cl.
*F26B 11/02* (2006.01)

(52) U.S. Cl. ..... 34/597; 68/18 C

(58) Field of Classification Search ..... 34/595, 34/597, 601, 602, 603, 605; 68/18 C
See application file for complete search history.

(56) References Cited

U.S. PATENT DOCUMENTS

| | | | | |
|---|---|---|---|---|
| 3,417,481 | A | 12/1968 | Rumsey | |
| 3,673,701 | A | 7/1972 | Albertson | |
| 3,866,333 | A | 2/1975 | Surakahanian et al. | |
| 3,921,308 | A * | 11/1975 | Freze | 34/395 |
| 4,103,433 | A | 8/1978 | Taylor | |
| 4,189,341 | A | 2/1980 | McPherson | |
| 4,204,339 | A * | 5/1980 | Muller | 34/75 |
| 4,819,341 | A | 4/1989 | Gayso | |
| 5,546,678 | A | 8/1996 | Dhaemers | |
| 5,715,555 | A | 2/1998 | Reber et al. | |
| 6,463,940 | B1 | 10/2002 | Thomas et al. | |
| 6,796,055 | B2 | 9/2004 | Baltes | |
| 6,868,621 | B1 | 3/2005 | Grimm et al. | |
| 6,904,703 | B2 | 6/2005 | Naganawa et al. | |
| 6,928,752 | B2 | 8/2005 | Johnson et al. | |
| 7,191,546 | B2 | 3/2007 | Maruca | |
| 2004/0088075 | A1 | 5/2004 | Batcher | |
| 2004/0154194 | A1 | 8/2004 | Prows | |
| 2004/0194339 | A1 | 10/2004 | Johnson et al. | |
| 2007/0169279 | A1 | 7/2007 | Park et al. | |

FOREIGN PATENT DOCUMENTS

| | | |
|---|---|---|
| DE | 3204718 | 9/1982 |
| DE | 19810907 | 9/1999 |
| DE | 19917206 | 10/2000 |
| DE | 10-2005-053702 | 6/2006 |
| EP | 1441059 | 7/2004 |
| GB | 2 026 147 | 1/1980 |

(Continued)

*Primary Examiner*—S. Gravini
(74) *Attorney, Agent, or Firm*—McKenna Long & Aldridge LLP

(57) ABSTRACT

An operation method for a combination dryer is disclosed. The present invention relates to a combination dryer, and more particularly, to an operation method for a combination dryer which enables air in a drying drum and a cabinet for drying the laundry to circulate continuously and enables condensed water generated in the circulation process to perform a refreshing cycle by using the water.

20 Claims, 5 Drawing Sheets

FOREIGN PATENT DOCUMENTS

| | | |
|---|---|---|
| JP | 04-126198 | 4/1992 |
| KR | 20-0243057 | 10/2001 |
| WO | WO 97/10376 | 3/1997 |
| WO | WO 2006/009375 | 1/2006 |
| WO | WO 2006/025650 | 3/2006 |
| WO | WO 2006/028326 | 3/2006 |

* cited by examiner

OPERATION METHOD AND DEVICE FOR COMBINATION DRYER

This application claims the benefit of the Patent Korean Application No. P2004-91274, filed on Nov. 10, 2004, which is hereby incorporated by reference as if fully set forth herein.

BACKGROUND OF THE INVENTION

1. Field of the Invention

The present invention relates to a combination dryer, and more particularly, to an operation method for a combination dryer which enables air in a drying drum and a cabinet for drying the laundry to circulate continuously and enables condensed water generated in the circulation process to perform a refreshing cycle by using the water.

2. Discussion of the Related Art

In general, a dryer is an electric home appliance which can dry cloth items, cloths and beddings (hereinafter, 'the laundry'). The dryer dries the laundry by supplying hot air to the washed laundry continuously.

FIG. 1 illustrates a conventional tumble dryer of a related art dryer.

That is, the related art tumble dryer includes a body 10, a drying drum 20, a door 40, a motor 50, a drying heater 60 and a fan 70.

The body 10 defines an exterior of the tumble dyer, and the drying drum 20 is rotatably mounted inside of the body 10.

Also, an opening 11 is formed in front of the body 10, and the door 40 is coupled for opening/closing the opening 11.

The motor 50 is secured to an inner downside of the body 10 for creating a driving force to rotate the drying drum 20 and the fan 70.

The drying heater 60 is mounted on an inner portion of a hot air supply channel 81 for heating air flowing within the hot air supply channel 81. The hot air supply channel 81 guides a hot air passage supplied into the drying drum 20.

The fan 70 discharges dry air flowing inside of the drying drum 10 outside, and is provided in communication with a hot air discharge channel 82.

Thus, once the fan 70 is put into operation, external air is guided by the hot air supply channel 81 and heated by passing through the drying heater 60 to be drawn into the drying drum 10.

Thereby, the damp laundry introduced into the drying drum 10 is getting dried by the heated external air gradually.

The air having dried the laundry by being circulated within the drying drum 10 is guided by the hot air supplying channel 82 to be discharged outside.

Once drying is completed by the repeated performance of the above process, the fane 70 and the drying heater 60 are stopped to finish a drying cycle.

However, the related art tumble dryer has a problem that drying for a tangled portion of the laundry is not dried smoothly, because the drying cycle is in process in a state of the laundry being introduced together at one time.

There is another problem that it is impossible to keep the laundry for a long time in the related art tumble dryer.

Thus, recently demands have been increasing accordingly for a new type of a combination dryer having a drying capacity thereof enlarged as well as capable of keeping the laundry for a long time. There are various combination dryers provided with tumble dryers having auxiliary cabinet dryers provided therewith, for example, U.S. Pat. No. 2004-0194339 A1 or U.S. Pat. No. 2004-0154194.

The above combination dryer allows a cabinet dryer provided on a top of a conventional dryer having a rotatory drum. The cabinet dryer has space for the laundry and receives hot air used to dry or keep the laundry for a long time.

However, the combination dryer described above has an inconvenience that a user should directly supply water needed for steam generation to refresh the laundry by using steam.

Especially, since a refreshing process may be performed even in lack of the water needed for the steam generation, a problem may be caused that the refreshing process is not performed smoothly.

SUMMARY OF THE INVENTION

Accordingly, the present invention is directed to an operating method for a combination dryer that substantially obviates one or more problems due to limitations and disadvantages of the related art.

An object of the present invention is to provide an operating method for a combination dryer that enables air for drying in a drying drum of a tumble dryer and a space of a cabinet dryer to be circulated continuously, such that water is generated in the circulation process to perform a refreshing cycle.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an operation method for a combination dryer comprises a controlling process for alternatively operating a drying cycle for drying the laundry and a refreshing cycle for refreshing the laundry, wherein the refreshing cycle comprises a step of supplying water for supplying water stored in a water storing chamber into a heating part; a step of generating steam for generating steam by evaporating the water within the heating part; and a step of supplying steam for supplying the steam into a drying drum of a tumble dryer and/or a laundry-keeping space of a cabinet dryer.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
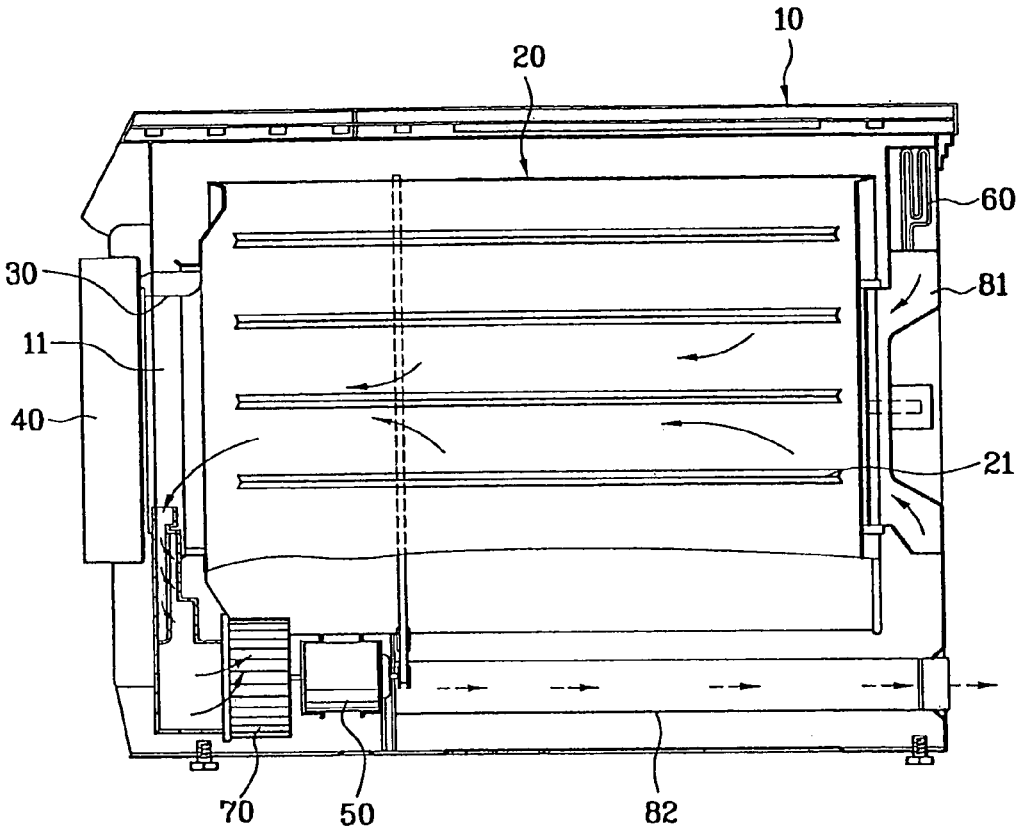
Related Art FIG. 1
FIG. 1 is a diagram illustrating an inner structure of a conventional tumble dryer.
Figure 2:
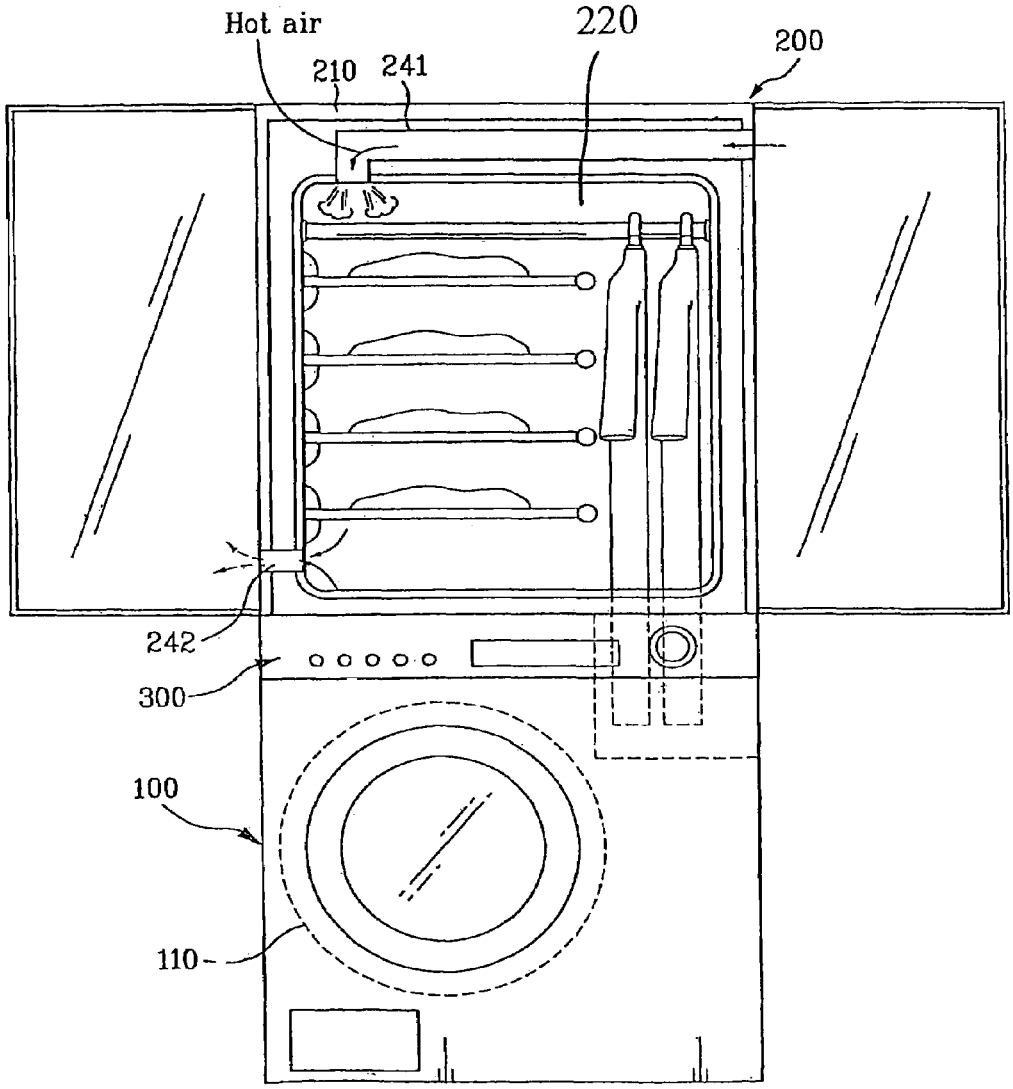
FIG. 2 is a diagram schematically illustrating an exterior of a combination dryer according to the present invention.
Figure 3:
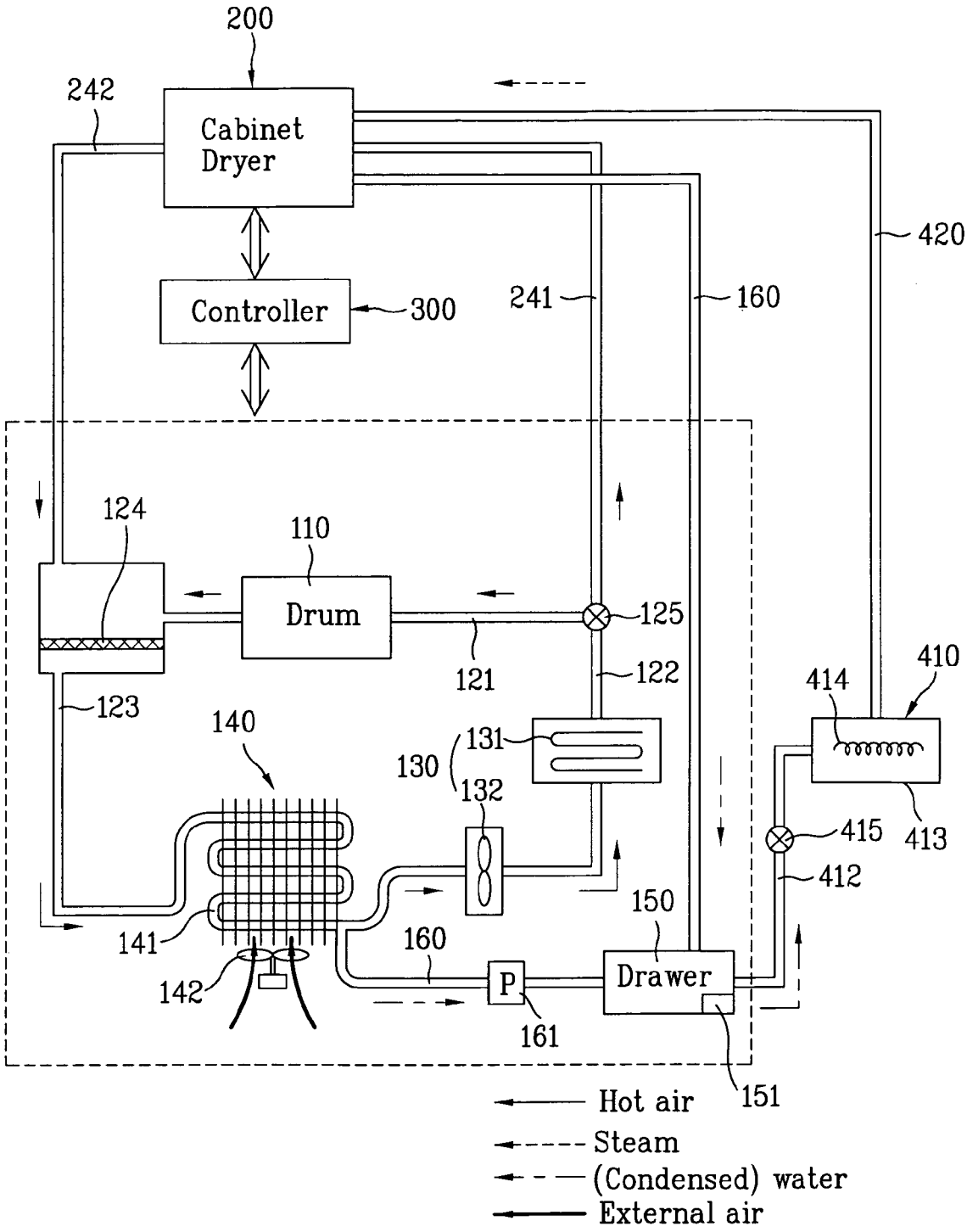
FIG. 3 is a block diagram schematically illustrating the combination dryer according to the present.

As shown in FIGS. 2 and 3, a combination dryer according to an embodiment of the present invention includes a tumble dryer 100, a cabinet dryer 200, and a control part 300.

The tumble dryer 100 performs only a drying cycle of the laundry.

The tumble dryer 100 includes a drying drum 110 capable of rotating and agitating, a hot air supplying pipe, a hot air supplying part 130, and an air condensing part 140.

The hot air supplying pipe as a pipe guiding a flow of high-temperature hot air is connectedly in communication with inside space among the drying drum 110, the air condensing part 140 and a cabinet dryer 200.

The hot air supplying pipe includes a first supplying pipe 121 for supplying hot air into the drying drum 110, a second supplying pipe 122 for receiving and supplying the air having passed through the air condensing part 140 to the first supplying pipe 121, and a third supplying pipe 123 for receiving and transmitting the air discharged from the drying drum 110 to the air condensing part 140.

A filtering part 124 may be further provided in the third supplying pipe 123 for filtering foreign substances contained in the flowing air.

Also, the hot air supplying part 130 is provided in the second supplying pipe 122 for generating hot air.

The hot air supplying part 130 includes a drying heater 131 for heating the air flowing inside of the second supplying pipe 122, a fan 132 for forcibly ventilating the air within the second supplying pipe 122.

Preferably, the fan 132 is provided in a portion of the second supplying pipe 122 allowing air drawn into the drying heater 131.

That is for minimizing damage of the fan 132 due to hot air.

Also, the air condensing part 140 condenses the air flowing along the hot air supplying pipe to radiate heat of the air.

The air condensing part 140 includes a condenser 141 and a condensing fan 142.

The condenser 141 receives the hot air from the third supplying pipe 123, and includes a pipe having a plurality of branched portions and a cooling pin.

The condensing fan 142 ventilates external air toward the condenser 141.

Furthermore, a water holding chamber 150 is further provided in the air condensing part 140. The water holding chamber 150 is connected with the air condensing part 140, the cabinet dryer 200 and a drain pipe 160.

The water holding chamber 150 holds condensed water generated in the air condensing part 140 and remaining washing water generated within the space for keeping the laundry in the cabinet dryer 200. Alternatively, a user may directly supply water to the water holding chamber 150.

Furthermore, a pump 161 is further provided in the drain pipe 160 for transmitting the water to the water holding chamber 150 after pumping the water forcibly.

Preferably, a water level sensor 151 is further provided in the water holding chamber 150 for sensing a level of the water stored in the water holding chamber 150.

The cabinet dryer 200 is mounted on a top of the tumble dryer 100, with a predetermined space having lots of the laundry kept therein.

The cabinet dryer 200 includes space 220 for keeping the laundry therein, a hot air inlet pipe 241, and an air outlet pipe 242.

A first end of the hot air inlet pipe 241 is connected to a portion of the second supplying pipe 122 where air is discharged, and a second end thereof is connectedly in communication with the space 220 keeping the laundry therein for transmitting the hot air from the second supplying pipe 122 into the space 220 keeping the laundry therein.

Preferably, an air channel valve 125 may be further provided in the second supplying pipe 122 for choosing and guiding a direction of the air flowing to the first supplying pipe 121 and/or the hot air inlet pipe 241.

Also, a first end of the air outlet pipe 242 is in communication with the space 220 keeping the laundry therein, and a second end thereof is connected to the third supplying pipe 123 to discharge the high-temperature humid air having passed through the laundry within the space 220.

At that time, an auxiliary exhaustion fan (not shown) may be further provided in the air outlet pipe 242.

On the other hand, the combination dryer according to the embodiment of the present invention further includes a steam generating part 410 for generating steam after receiving the water stored in the water holding chamber 150, and a steam supplying pipe 420 for supplying the steam generated in the steam generating part 410 to the cabinet dryer 200.

The steam generating part 410 is provided in either of the tumble dryer 100 and the cabinet dryer 200.

The steam generating part 410 includes a water supplying pipe 412 for receiving the water from the water holding chamber 150, a heating part 413 having space for temporally holding the water from the water supplying pipe 412, and a heating element 414 provided within the heating part 413 for heating the stored water into steam.

Preferably, an opening/closing valve 415 may be further provided for alternatively opening or closing the inflow of the water supplied to the heating part 413.

The control part 300 according to the present invention controls operation of the tumble dryer 100 and the cabinet dryer 200.

At that time, the control part 300 may be provided in at least one of the tumble dryer 100 and the cabinet dryer 200, and it is preferred but not necessary that the control part 300 is provided only in the tumble dryer as shown in the embodiment of the present invention.

If the control part 300 is provided in both the tumble dryer 100 and the cabinet dryer 200, the control parts 300 are connected by a data cable (not shown) to make possible to intercommunicate information.

Also, the control part 300 may control the tumble dryer 100 and the cabinet dryer 200 respectively, and may control the tumble dryer 100 and the cabinet dryer 200 to communicate each other.

The combination dryer with the configuration described above may operate a refreshing cycle for refreshing the laundry, as well as a drying cycle.

At that time, the refreshing cycle makes the dried laundry in a state before getting dressed such as smoothing out the wrinkles, and is operated by using a high-temperature steam.

According to the embodiment of the present invention, the refreshing cycle is operated only in the cabinet dryer 200.

Alternatively, the refreshing cycle may be operated in the tumble dryer. But since there is a lots of the laundry tangled in the tumble dryer 100, the outstanding effect of the refreshing cycle is not expected. If a rack is further provide for holding the laundry after separating the laundry and the refreshing cycle is operated in the tumble dryer 100, the refreshing effect may be expected.

It is a distinguishable outstanding technical feature of the present invention that water used for generating steam is created in the combination dryer itself, unlike the related art in that the user supplies extra water for generating steam.

That is, the water stored within the water holding chamber 150 is used for the water needed to generate steam.

Since a lot of water is created in the air condensing part 140 of the combination dryer according to the present invention and also there is a lot of water within the space keeping the laundry therein, the water is supplied enough to generate steam.

Figure 4:
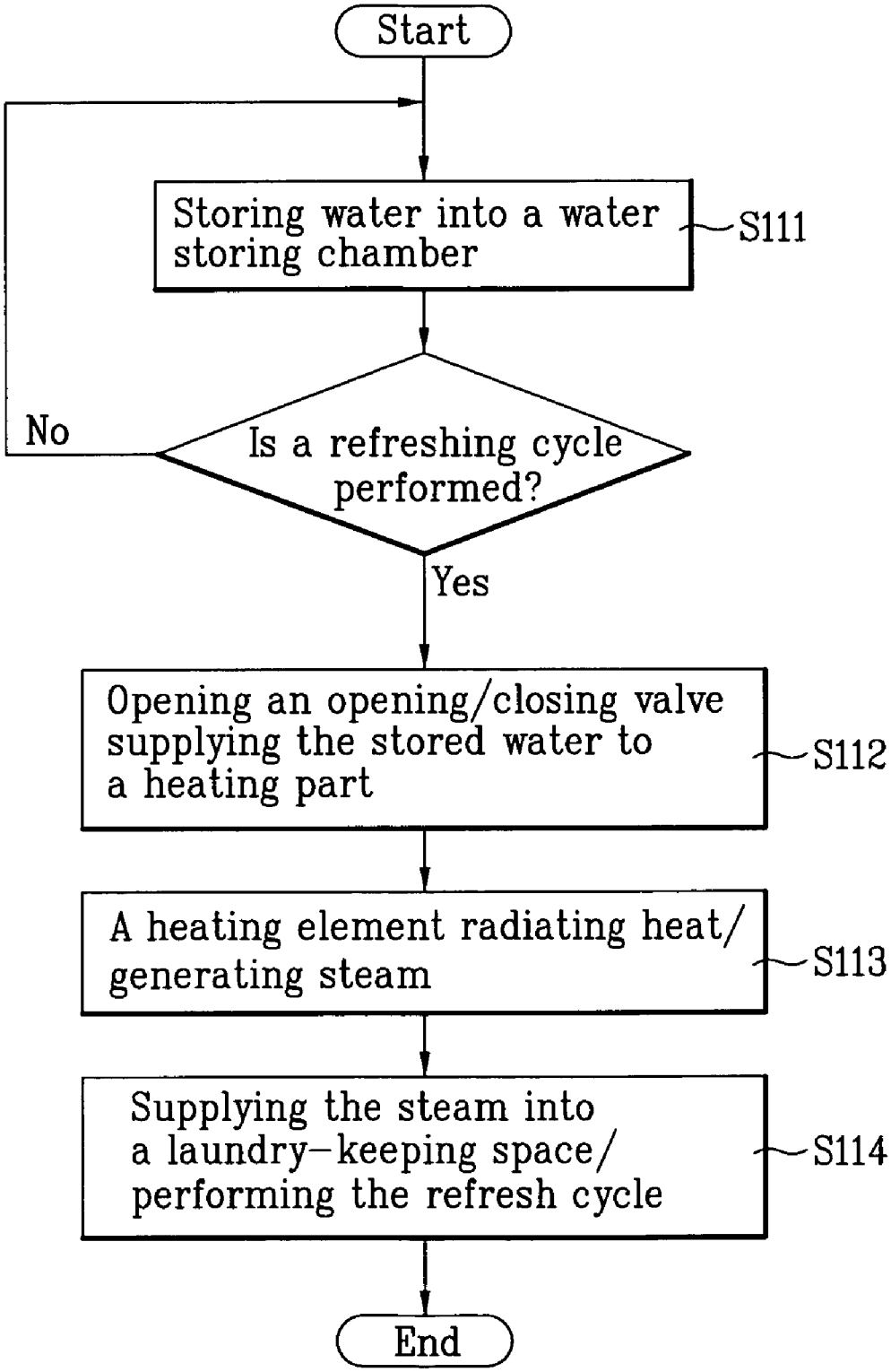
FIG. 4 is a flow chart schematically illustrating a controlling process when operating a refreshing cycle in the combination dryer according to the present invention.

Referring to FIG. 4, an embodiment for a refreshing cycle of the combination dryer according to the present invention will be described.

First, for the refreshing cycle, a sufficient amount of water is stored in the water storing chamber (S111).

At that time, the water may be stored during the drying cycle after receiving the washing water remaining in the drying drum 110 of the tumble dryer 100 and/or the space keeping the laundry in the cabinet dryer 200. Alternatively, the water is stored after receiving the condensed water created by condensing the high-temperature hot air having passed through the air condensing part.

The drying cycle is a series of processes drying the laundry in the drying drum 110 and/or the space 220 keeping the laundry therein by supplying high-temperature dry air into the drying drum 110 and/or the space 220 through the drying heater 131 and the fan 132.

At that time, the dry air supplied into the drying drum 110 and/or the space 220 reaches high temperatures by the drying heater 131, and flows along each supplying pipe 121, 122 and 123 by the fan 132. Hence, in the middle of passing through the air condensing part 140, the dry air is heat-exchanged and condensed in the condenser 141 by the condensing fan 142 to be dried.

Alternatively, the water may be stored during the refreshing cycle after receiving the water created in the drying drum 110 of the tumble dryer 100 and/or the space 220 of the cabinet dryer 200.

As described above, once the refreshing cycle is required to be operated in a state of a sufficient amount of water being stored in the water storing chamber 150, the opening/closing valve 413 in the water supplying pipe 412 is opened (S112).

Thus, the water in the water storing chamber 150 is supplied to the heating part 413 through the water supplying pipe 412.

If the refreshing cycle is not required to be operated, only a series of the processes storing the water in the water storing chamber 150 is continuously repeated.

Hence, the control part 300 controls the heating element 414 provided in the heating part 413 to radiate heat (S113).

Thereby, the water within the heating part 413 turns into vapor to created hot steam.

The steam is supplied though the steam supplying pipe 420 into the space 220 of the cabinet dryer 200 (s114).

Thus, due to the hot steam, wrinkles of the laundry are smoothed out and also microorganisms such as various kinds of mold fungi are sterilized.

As described before, it is preferred but not necessary that the amount of the water stored in the water storing chamber 150 should be always sufficient during the refreshing cycle.

Figure 5:
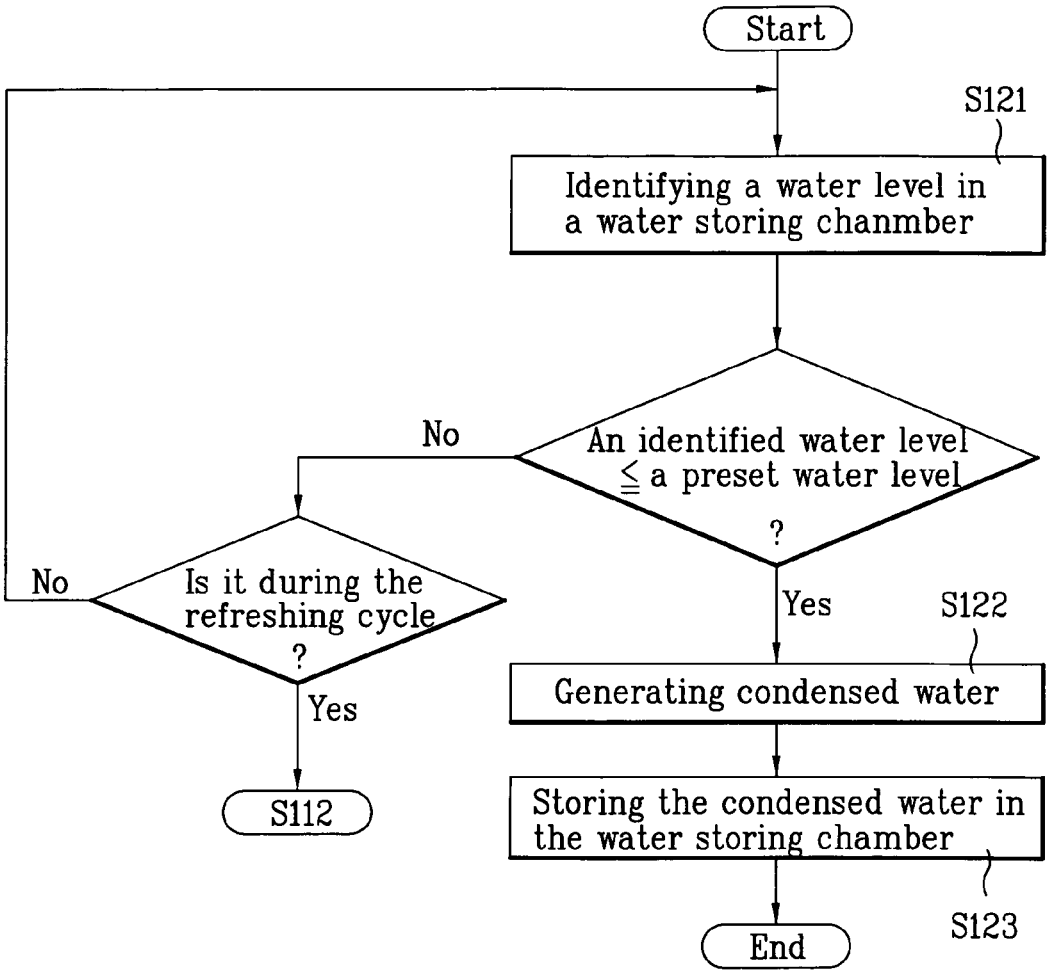
FIG. 5 is a flow chart schematically illustrating a controlling process during the operation of the refreshing cycle.

For that, as shown in a flow chart of FIG. 5, the control part 300 constantly identifies a water level within the water chamber 150 by controlling the water level sensor 151 during the refreshing cycle (S121). If the water level identified is lower than the water level preset to create steam, a series of processes is performed for generating condensed water.

Preferably, the above control of the water level sensor 151 and the supplementary process for generating the condensed water is performed at the beginning of the refreshing cycle, that is, before generating the steam, so that the water level may always be maintained at proper levels.

Also, the series of the processes may be processes generating steam by circulating the air into the hot air supplying pipe and condensing the circulated air.

The air circulation into the hot air supplying pipe is possible through the control of the fan driving. Preferably, heating the drying heater 131 as well as controlling to operate the condensing fan 142 may enable more water to be created.

In other words, the condensed water needed to create steam is generated by condensing the high temperature hot air after heat-exchanging. At that time, the created condensed water may be supplied to the water storing chamber 150 through controlling of the pump 161 driving (S123).

As shown in the series of the processes according to the embodiment of the present, it is possible to supply the water needed to create the steam for the refreshing cycle, thereby preventing lack of the water.

Therefore, the combination dryer according to the embodiment of the present invention has an advantageous industrial effect that the laundry may be sterilized, as well as the wrinkles thereof may be smoothed out, due to the refreshing cycle.

Especially, since the steam for the refreshing cycle uses the condensed water created in the combination dryer, an inconvenience is removed that the user should identify the water for creating the steam and supply the water.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An operating method for a combination dryer including a tumble dryer and cabinet dryer comprising:

a controlling process for alternatively operating a drying cycle for drying the laundry and a refreshing cycle for refreshing the laundry, wherein the refreshing cycle comprises steps of:

supplying water stored in a water storing chamber into a heating part, the water storing chamber receiving condensed water from a condensation process occurring within the combination dryer;

generating steam by evaporating condensed water within the heating part; and supplying steam into a drying drum of a tumble dryer and/or a laundry-keeping space of a cabinet dryer.

2. The operating method for the combination dryer of claim 1, further comprising a step of storing water within the water storing chamber before the step of supplying water.

3. The operating method for the combination dryer of claim 2, wherein the step of storing water is performed by storing condensed water generated in the tumble dryer into the water storing chamber during the drying cycle.

4. The operating method for the combination dryer of claim 2, wherein the step of storing water is performed by storing condensed water generated in the cabinet dryer into the water storing chamber during the drying cycle.

5. The operating method for the combination dryer of claim 2, wherein the step of storing water is performed by storing condensed water generated in the tumble dryer into the water storing chamber during each process of the refreshing cycle.

6. The operating method for the combination dryer of claim 2, wherein the step of storing water is performed by storing condensed water generated in the cabinet dryer into the water storing chamber during each process of the refreshing cycle.

7. The operating method for the combination dryer of claim 1, further comprising a step of identifying a water level of the water stored in the water storing chamber.

8. The operating method for the combination dryer of claim 7, further comprising a step of generating condensed water as supplementary water in case the water level identified in the step of checking a water level is lower than the water level needed for generating steam.

9. The operating method for the combination dryer of claim 8, wherein the condensed water is generated by condensing the air circulated in the tumble dryer.

10. The operating method for the combination dryer of claim 8, wherein the condensed water is generated by condensing the air circulated in the cabinet dryer.

11. The operating method for the combination dryer of claim 8, wherein the condensed water is generated by condensing the air circulated in the tumble dryer and the cabinet dryer.

12. The operating method for the combination dryer of claim 8, wherein the step of generating condensed water is performed before the step of generating steam starts.

13. The operating method for the combination dryer of claim 12, wherein the condensed water is generated by condensing the air circulated in the tumble dryer.

14. The operating method for the combination dryer of claim 12, wherein the condensed water is generated by condensing the air circulated in the cabinet dryer.

15. The operating method for the combination dryer of claim 12, wherein the condensed water is generated by condensing the air circulated in the tumble dryer and the cabinet dryer.

16. The operating method for the combination dryer of claim 8, wherein the step of generating condensed water is continuously performed during the refreshing cycle.

17. The operating method of the combination dryer of claim 16, wherein the condensed water is generated by condensing the air circulated in the tumble dryer.

18. The operating method for the combination dryer of claim 16, wherein the condensed water is generated by condensing the air circulated in the cabinet dryer.

19. The operating method for the combination dryer of claim 16, wherein the condensed water is generated by condensing the air circulated in the tumble dryer and the cabinet dryer.

20. The operating method for the combination dryer of claim 1, wherein the steam in the step of supplying steam is supplied into the drying drum and the laundry-keeping space at the same time, or the steam is supplied into either the drying drum or the laundry-keeping space at different times.

* * * * *